US005804913A

United States Patent [19]

Grubben et al.

[11] Patent Number: 5,804,913

[45] Date of Patent: Sep. 8, 1998

[54] CATHODE RAY TUBE WITH FLEXIBLE MOUNT FOR DEFLECTION UNIT

[75] Inventors: Antonius P. M. Grubben; Edward P. V. Maesen; Johannes H. F. C. Sieben, all of Eindhoven, Netherlands

[73] Assignee: U.S. Philips Corporation, New York, N.Y.

[21] Appl. No.: 625,958

[22] Filed: Apr. 1, 1996

[30] Foreign Application Priority Data

Apr. 5, 1995 [EP] European Pat. Off. ..... 95200861

[51] Int. Cl.[6] ..... H01J 29/76

[52] U.S. Cl. ..... 313/440; 313/426; 348/829; 335/213

[58] Field of Search ..... 313/440, 442, 313/426; 348/829, 830, 831; 335/213, 214, 212

[56] References Cited

U.S. PATENT DOCUMENTS 4,096,531 6/1978 Yamada et al. ..... 335/213
4,206,481 6/1980 Imahashi et al. ..... 335/213
4,794,300 12/1988 Beelaard et al. ..... 313/440
5,404,121 4/1995 Cho ..... 335/214
5,557,165 9/1996 Descombes et al. ..... 313/440

FOREIGN PATENT DOCUMENTS

WO9603766 8/1996 WIPO ..... H01J 29/76

*Primary Examiner*—Michael Horabik
*Assistant Examiner*—Michael Day
*Attorney, Agent, or Firm*—Robert J. Kraus

[57] ABSTRACT

A cathode ray tube (1) including an electron gun (6) for generating at least one electron beam and a deflection unit for deflecting the electron beam(s) across a display screen. The deflection unit (11) includes a first system (21) and a second system (22, 32) of saddle-shaped deflection coils. Which are interconnected via connecting pieces (41, 51, 63, 64) which are flexibly arranged with respect to each other.

5 Claims, 5 Drawing Sheets

CATHODE RAY TUBE WITH FLEXIBLE MOUNT FOR DEFLECTION UNIT

BACKGROUND OF THE INVENTION

The invention relates to a cathode ray tube comprising, in an evacuated envelope, a means for generating at least one electron beam and a display screen, the cathode ray tube being provided with a deflection unit for deflecting the electron beam(s) across the display screen, the deflection unit comprising at least one system of saddle-shaped deflection coils.

The invention also relates to a deflection unit for a cathode ray tube.

Such cathode ray tubes are used, inter alia, for television receivers, computers etc.

Cathode ray tubes of the type mentioned in the opening paragraph are well-known. During operation of such cathode ray tubes, the electron beams are deflected across the display screen by the deflection unit.

During operation of the cathode ray tube, its temperature and that of the deflection unit increase, inter alia, as a result of the fact that heat is generated in the deflection coils. This causes the position of the coils to change with respect to each other and/or with respect to the rest of the cathode ray tube. This change in position has an influence on the deflection of the electron beams.

SUMMARY OF THE INVENTION

It is an object of the invention to provide a cathode ray tube of the type mentioned in the opening paragraph and a deflection unit for a cathode ray tube, which ensure that the influence of a rise in temperature of the cathode ray tube on the deflection of the electron beams is reduced.

This object is achieved in accordance with a first aspect of the invention by a cathode ray tube of the type mentioned in the opening paragraph, which comprises a first and a second system of saddle-shaped deflection coils, wherein that the deflection coil systems are interconnected via connecting pieces which are flexibly arranged with respect to each other.

In accordance with a second aspect of the invention, a cathode ray tube of the type mentioned in the opening paragraph, comprises a system of saddle-shaped deflection coils and a deflection-coil holder which are interconnected via connecting pieces which are flexibly arranged with respect to each other.

In well-known deflection units, the saddle-shaped coils are mounted on a rigid coil holder composed of a rigid, more or less funnel-shaped, synthetic resin body. The coil holder forms the support of the deflection unit on which the deflection coils and any further components are provided. The deflection coils often are secured to the inside and the outside of the funnel-shaped coil holder. A rise in temperature causes the deflection coils and the holder to expand. This may result in a change of place of the deflection coils with respect to each other. This has a negative effect on the deflection of the electron beams.

A cathode ray tube in accordance with the invention, or a deflection unit for a cathode ray tube in accordance with the invention, comprises saddle-shaped deflection coil systems which are interconnected via connecting pieces which are flexibly arranged with respect to each other, or, if there is only one system of saddle-shaped deflection coils, the system and the coil holder are interconnected by connecting pieces which are flexibly arranged with respect to each other. By virtue of the flexible arrangement of the connecting pieces, differences between the coefficients of thermal expansion of the coil systems and the coil holder are compensated for during use of the cathode ray tube. As a result, the coil systems remain aligned with respect to each other. The advantage over the well-known construction is caused by the fact that in the said well-known construction there is a fairly large difference in thermal expansion between the coils (which are predominantly composed of metal, mostly copper) and the coil holder, which is generally made of a synthetic resin, whereas in the cathode ray tube in accordance with the invention, this difference in thermal expansion hardly plays a role, or perhaps none at all, owing to the flexible arrangement of the connecting pieces relative to each other. Both coil systems are interconnected in such a manner that they expand jointly and constitute an integral part as regards thermal expansion. In the well-known deflection units, the coil systems are serated by a coil holder and there is no connection between the thermal expansion values of the coils.

The deflection unit preferably comprises a coil holder which is provided on the inside and on the outside with, respectively, the first and the second system of deflection coils, and the connecting pieces are connected to the coil holder via flexible connections. The flexible connections compensate for differences in expansion between the holder and the coil assembly.

In an embodiment, the connecting pieces comprise a first and a second set of connecting pieces which are arranged along the z-axis at some distance from each other, the connection between the first and the second set being formed by the coils only. In this embodiment, the coils are interconnected by the connecting pieces, the coils forming a self-supporting integral part and hence constituting the supporting part of the deflection unit. In these embodiments, the main function of the coil holder is taken over by the assembly of both coil systems.

These and other aspects of the invention will be apparent from and elucidated with reference to the embodiments described hereinafter.

DETAILED DESCRIPTION OF THE PREFERRED EMBODIMENTS

Figure 1:
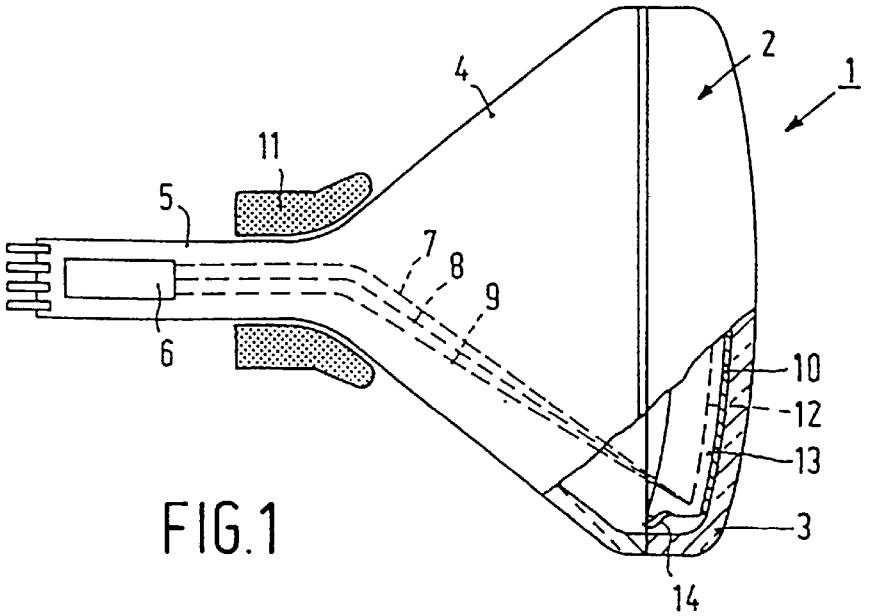
FIG. 1 is a sectional view of a cathode ray tube.

The Figures are not drawn to scale. In the Figures, like reference numerals generally refer to like parts.

A colour cathode ray tube 1 has an evacuated envelope 2 comprising a display window 3, a cone portion 4 and a neck 5. In the neck 5, there is provided an electron gun 6 for generating three electron beams 7, 8 and 9. A display screen 10 is situated on the inside of the display window. The display screen 10 comprises a phosphor pattern of phosphor elements luminescing in red, green and blue. On their way to the display screen, the electron beams 7, 8 and 9 are deflected across the display screen 10 by means of a deflection unit 11 and pass through a colour selection electrode 12 which is arranged in front of the display window 3 and which comprises a thin plate having apertures 13. The colour selection electrode is suspended in the display window by means of suspension means 14. The three electron beams pass through the apertures of the shadow mask and each electron beam impinges on phosphor elements of only one colour.

Figure 2:
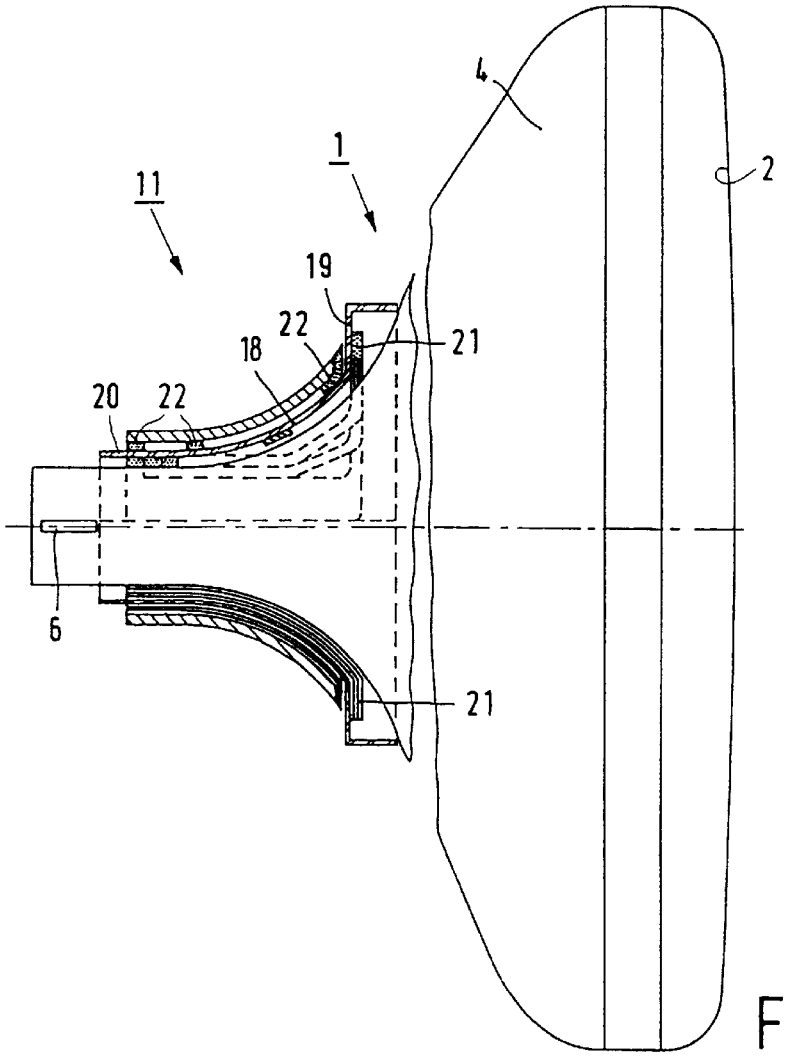
FIG. 2 is a schematic, sectional view of a well-known construction of a cathode ray tube comprising a deflection unit.

FIG. 2 is a schematic, sectional view of a well-known construction of a cathode ray tube comprising a deflection unit 11. The deflection unit comprises a coil holder 18 of an electrically insulating material (often synthetic resin) having a front end portion 19 and a rear end portion 20. Between the end portions, on the inside of the coil holder, there is a line deflection coil system 21 for generating a (line) deflection field for deflecting electron beams generated by the electron gun 6 in the horizontal (line) direction, and a field deflection coil system 22 for generating a (field) deflection field in the vertical direction is situated on the outside of the coil holder. Each coil system generally comprises two sub-coils.

Both coil systems are attached to the coil holder 18. During operation of the cathode ray tube, its temperature and, in particular, that of the deflection unit increase. The coil systems are attached (for example by means of an adhesive or by means of hooks) to the coil holder. Differences in thermal expansion between the coil holder and the coils cause the positions of the line and field deflection coil systems 21, 22 to change relative to each other and bring about thermal stresses between the coil systems 21, 22 and the coil holder 18. These effects have a negative influence on the quality of the deflection field.

Figure 3:
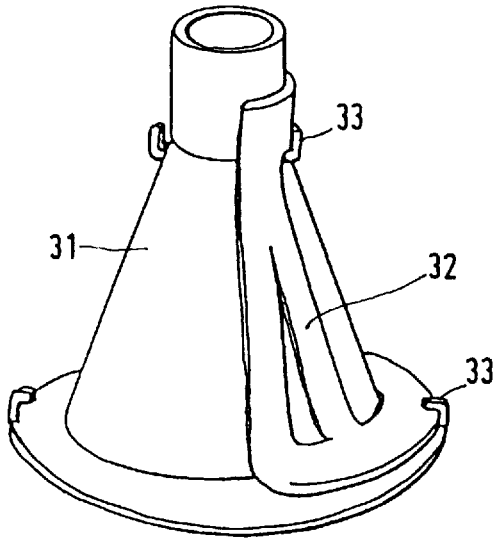
FIG.3 PRIOR ART
FIG. 3 is a perspective, much simplified, view of a well-known coil holder.

FIG. 3 is a perspective, much simplified, view of a well-known coil holder 31 having a sub-coil 32. In this case, said sub-coil is attached to the coil holder by means of hooks 33.

Figure 4A:
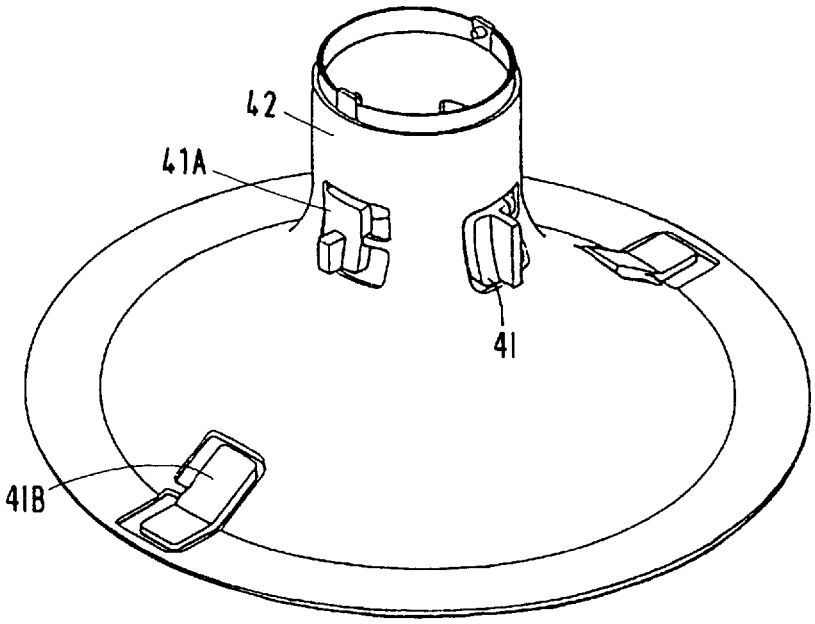
FIGS. 4A and 4B show a detail of a deflection unit in accordance with the invention.
Figure 4B:
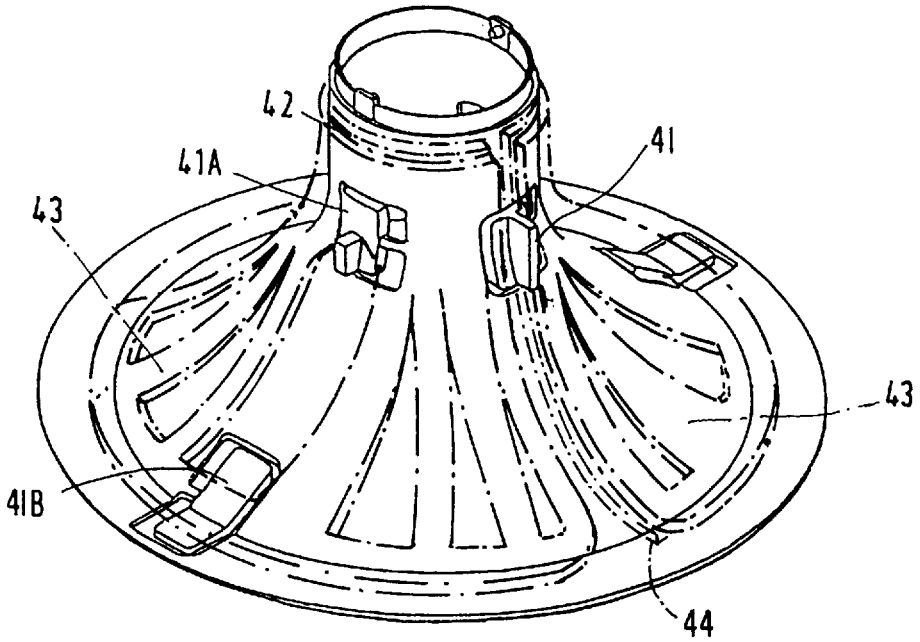

FIG. 4A is a perspective view of a coil holder for a deflection unit in accordance with the invention. Connecting pieces 41 are flexibly attached to the coil holder 42 by means of strips. In FIG. 4B, the coil holder shown in FIG. 4A is provided with coils 43 shown in phantom. Two coils 43 form a coil system which is attached via connecting pieces 41, 41A and 41B to the outside of the coil holder 42. Both coils are fixed to common connecting pieces 41. The coil holder is also provided on the inside with two coils 44 (also illustrated by coils 21 in FIG. 2), which are attached to the connecting pieces 41, 41A and 41B. The coil systems are fixedly mounted to the connecting pieces, for example, by means of an adhesive. If the temperature increases, the coil systems can expand simultaneously relative to each other and relative to the coil holder. Consequently, the positions of the coil systems relative to each other do not change. In this embodiment, use is still made of the coil holder. In this embodiment, two coil systems are attached to the coil holder. In an alternative embodiment, one of the coil systems can be attached to the coil holder, for example the coil system formed by coils 43 as shown in FIG. 4B, while the other coil system is a so-called toroidal coil system, i.e. two coils are wound around a magnetic core, so that the magnetic core comprising coils is arranged around the coils 43 like a ring. The advantage of such an embodiment is that the coils 43 are flexibly arranged relative to the coil holder, so that thermal stresses between the coil holder and the coils 43 are precluded.

Figure 5B:
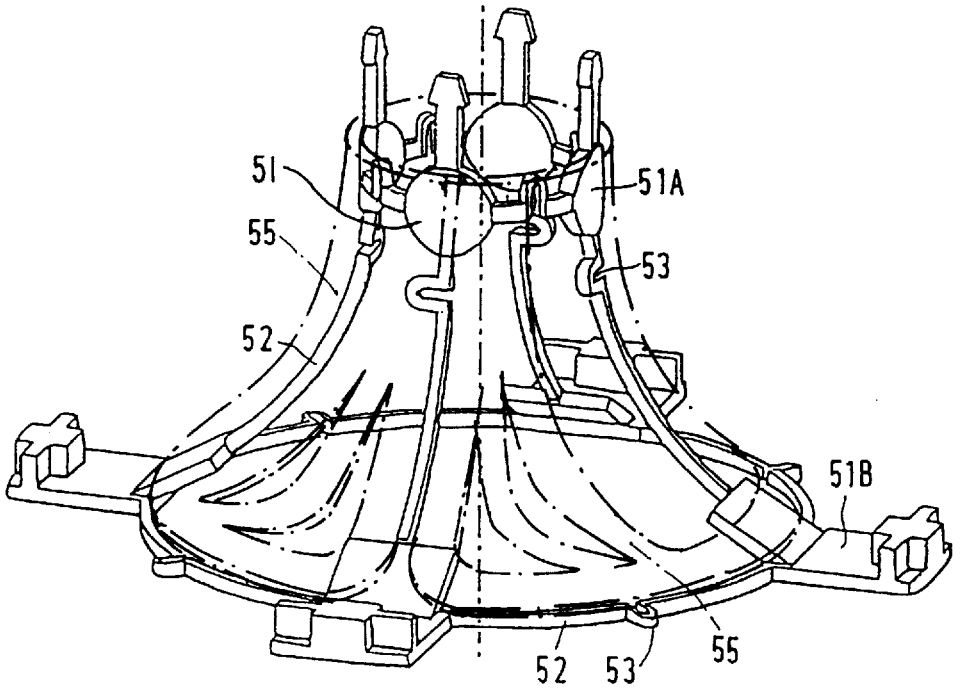
FIGS. 5A, 5B show a detail of a second embodiment of a deflection unit in accordance with the invention.
Figure 5A:
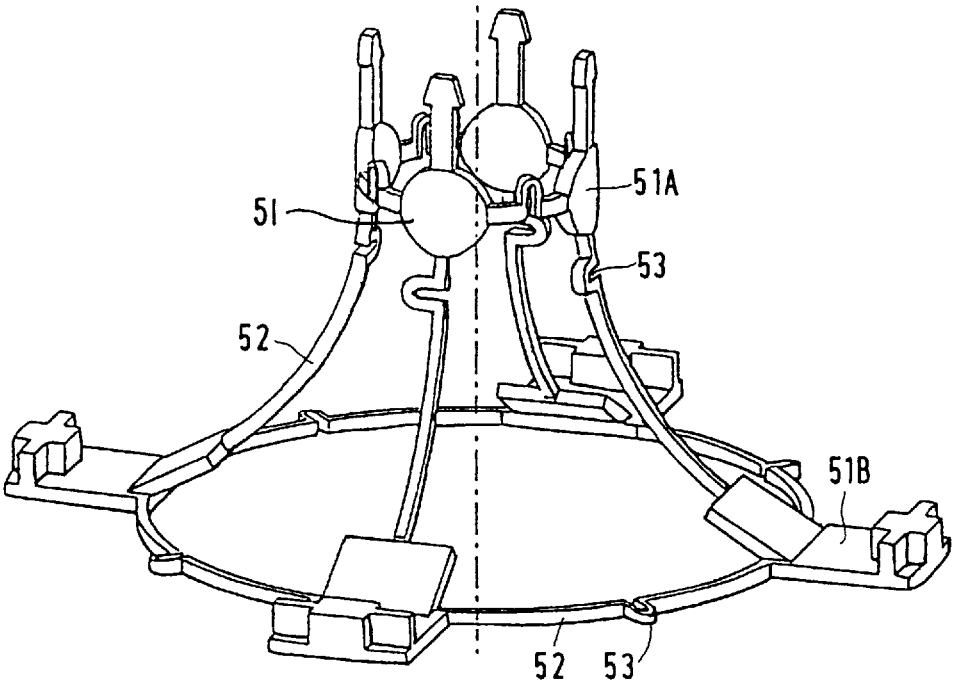

FIGS. 5A and 5B show a further embodiment of a coil holder for a deflection unit in accordance with the invention. This example represents more or less a skeleton structure of the coil holder. In this example, the connecting pieces 51, 51A , 51B are interconnected by synthetic resin strips 52 in which expansion bends 53 are formed which ensure that the connecting pieces can move relative to each other. FIG. 5A shows the holder without coils, FIG. 5B shows the holder with coils 55 shown in phantom.

Figure 6A:
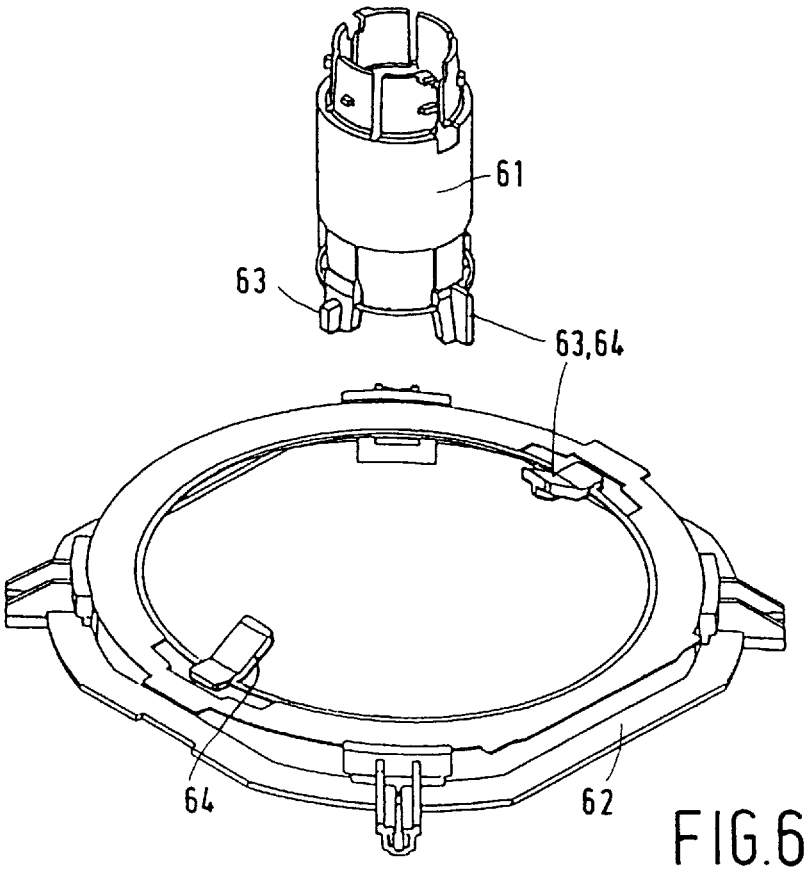
FIGS. 6A and 6B show a detail of a third embodiment of the deflection unit.
Figure 6B:
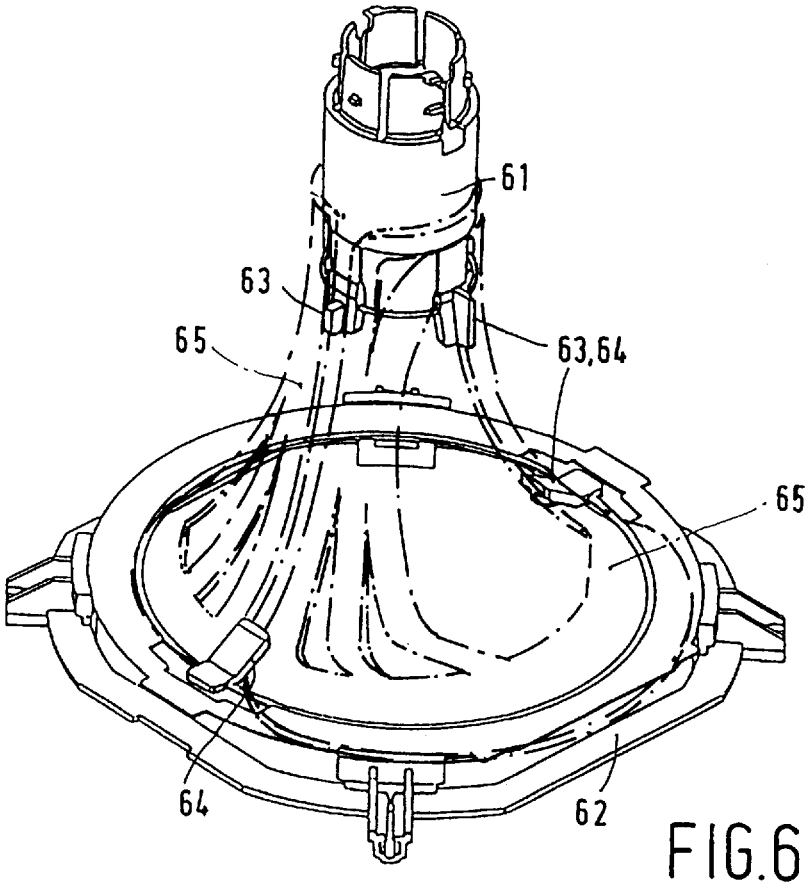

FIGS. 6A and 6B show another embodiment of a deflection unit in accordance with the invention. In this embodiment, the coil holder is replaced by a front portion 61 and a rear portion 62. The front portion comprises a first set of connecting pieces 63; the rear portion comprises a second set of connecting pieces 64. The connecting pieces are resiliently attached to the front and rear portions. FIG. 6A shows the various components of the coil holder without the connecting coils; FIG. 6B shows the coil holder with the coils 65.

In the embodiment shown in FIGS. 6A and 6B, the connecting pieces comprise two sets of connecting pieces (63 and 64) which are arranged along the z-axis at some distance from each other, the connection between the first and the second set being formed only by the coils 65. The coils 65 are natually somewhat flexible.

The invention is also based on the following insight:

In the manufacture of deflection units and in positioning a deflection unit on a cathode ray tube, forces are exerted on the deflection unit. Also during transport and use of the cathode ray tube, the deflection unit is subject to forces. So far it has been assumed that, in order to withstand such forces, deflection coils must be attached to a rigid coil holder. However, the inventors have come to recognize that by securing both coil systems to each other via connecting pieces, the technique of manufacturing coils is improved to such an extent that the assembly of coils and connecting pieces can be rendered self-supporting.

It will be obvious that within the scope of the invention many variations are possible.

We claim:

1. A cathode ray tube comprising an evacuated envelope, a display screen in said evacuated envelope, a first pair at saddle shaped deflection coils for deflecting at least one electron beam across the display screen, a second pair of saddle shaped deflection coils for deflecting at least one electron beam across the display screen, said second pair of coils being situated inside said first pair, connecting pieces to which both coils of each pair are fixedly mounted, said connecting pieces being arranged movably with respect to each other, whereby the relative positions at the deflection coils in each pair, as well as the relative position of the pairs, are maintained during a rise in temperature.

2. A cathode ray tube as in claim 1, further comprising a coil holder between said first and second pairs of coils, said connecting pieces being flexibly connected to said coil holder.

3. A cathode ray tube as in claim 1, comprising a z-axis normal to said display screen, said connecting pieces comprising a first set of connecting pieces and a second set of connecting pieces arranged along the z-axis at some distance from each other.

4. A cathode ray tube as in claim 1 wherein both coils of at least one of said pairs are fixedly mounted to at least one common one of said connecting pieces.

5. A cathode ray tube comprising an evacuated envelope, a display screen in said evacuated envelope, at least one electron beam in said evacuated envelope, a deflection unit for deflecting said at least one electron beam across the display screen, the deflection unit comprising a pair of saddle shaped deflection coils situated outside the envelope, and connecting pieces to which said coils are fixedly mounted, both coils being mounted to at least one common one of said pieces, said pieces being flexibly arranged with respect to each other.

* * * * *